US006217350B1

(12) United States Patent
Johnson et al.

(10) Patent No.: US 6,217,350 B1
(45) **Date of Patent: *Apr. 17, 2001**

(54) MEDIA JACK ADAPTOR AND SYSTEM

(75) Inventors: Thomas A. Johnson, Draper; Ryan A. Kunz, Kearns, both of UT (US)

(73) Assignee: 3Com Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/241,341

(22) Filed: Feb. 1, 1999

(51) Int. Cl.[7] ..... H04R 13/44

(52) U.S. Cl. ..... 439/131; 439/946; 361/737

(58) Field of Search ..... 439/131, 676, 439/946.2, 55, 78, 64, 79; 361/737

(56) References Cited

U.S. PATENT DOCUMENTS

| | | | |
|---|---|---|---|
| 2,916,720 | 12/1959 | Steans | 339/91 |
| 4,186,988 | 2/1980 | Kobler | 339/176 |
| 4,241,974 | 12/1980 | Hardesty | 339/154 |
| 4,303,296 | 12/1981 | Spaulding | 339/122 |
| 4,352,492 | 10/1982 | Smith | 273/1 |
| 4,407,559 | 10/1983 | Meyer | 339/126 |
| 4,428,636 | 1/1984 | Kam et al. | 339/97 |
| 4,710,136 | 12/1987 | Suzuki | 439/374 |
| 4,778,410 | 10/1988 | Tanaka | 439/676 |
| 4,915,648 | 4/1990 | Takase et al. | 439/490 |
| 5,035,641 | 7/1991 | Van-Santbrink et al. | 439/329 |
| 5,051,099 | 9/1991 | Pickles et al. | 439/108 |
| 5,139,439 | 8/1992 | Shie | 439/359 |
| 5,183,404 | 2/1993 | Aldous et al. | 439/55 |
| 5,184,282 | 2/1993 | Kaneda et al. | 361/395 |
| 5,336,099 | 8/1994 | Aldous et al. | 439/131 |
| 5,338,210 | 8/1994 | Beckham et al. | 439/131 |
| 5,391,094 | 2/1995 | Kakinoki et al. | 49/638 |
| 5,411,405 | 5/1995 | McDaniels et al. | 439/131 |
| 5,481,616 | 1/1996 | Freadman | 381/90 |
| 5,499,923 | 3/1996 | Archibald et al. | 439/26 |
| 5,505,633 | 4/1996 | Broadbent | 439/329 |
| 5,509,811 | 4/1996 | Homic | 439/55 |
| 5,538,442 | 7/1996 | Okada | 439/676 |
| 5,547,401 | 8/1996 | Aldous et al. | 439/676 |
| 5,561,727 | 10/1996 | Akita et al. | 385/88 |
| 5,562,504 | 10/1996 | Moshayedi | 439/638 |

(List continued on next page.)

FOREIGN PATENT DOCUMENTS

| | | |
|---|---|---|
| 61-256850 | 11/1986 | (JP) . |
| WO 95/13633 | 5/1995 | (WO) . |

OTHER PUBLICATIONS

P.E. Knight and D.R. Smith, "Electrical Connector for Flat Flexible Cable," IBM Technical Disclosure Bulletin, vol. 25, No. 1, Jun. 1982.

*Primary Examiner*—Tulsidas Patel
(74) *Attorney, Agent, or Firm*—Workman, Nydegger & Seeley

(57) ABSTRACT

A system for housing and receiving a media jack includes (i) an adaptor having an adaptor body having a track for receiving a media jack; and a wing extending from one side of the adaptor body; and (ii) first and second shells. Each shell includes a plate and a rail mounted on the plate. The wing is configured to be coupled between the first and second shells. Thus the wing is maintained securely between the shells. The wing has a plurality of apertures extending therethrough for receiving posts extending from the shells. The wing also has a plurality of posts extending therefrom which are positioned within recesses in the shells.

16 Claims, 7 Drawing Sheets

U.S. PATENT DOCUMENTS

| | | | | |
|---|---|---|---|---|
| 5,608,607 | | 3/1997 | Dittmer | 361/686 |
| 5,634,802 | | 6/1997 | Kerklaan | 439/131 |
| 5,660,568 | | 8/1997 | Moshayedi | 439/654 |
| 5,667,390 | * | 9/1997 | Keng | 439/946 |
| 5,667,395 | | 9/1997 | Okada et al. | 439/131 |
| 5,679,013 | | 10/1997 | Matsunaga et al. | 439/144 |
| 5,727,972 | | 3/1998 | Aldous et al. | 439/655 |
| 5,773,332 | | 6/1998 | Glad | 439/344 |
| 5,797,771 | | 8/1998 | Garside | 439/610 |
| 5,816,832 | * | 10/1998 | Aldous et al. | 439/131 |
| 5,938,480 | * | 8/1999 | Aldous et al. | 439/676 |
| 5,971,777 | * | 10/1999 | Garside | 439/131 |
| 5,989,042 | | 11/1999 | Johnson et al. | 439/131 |

* cited by examiner

MEDIA JACK ADAPTOR AND SYSTEM

BACKGROUND OF THE INVENTION

1. The Field of the Invention

The present invention relates to the field of computers. More particularly, the present invention relates to an interface between a connector and a communications card in a computer system, and specifically to an adaptor and housing for a physical/electrical media connector interface for use in a PCMCIA-architecture communications card.

2. The Prior State of the Art

As is well known, telecommunications-type devices—such as modems, network interface cards and the like—require some means for physically and electrically interconnecting with a corresponding communications medium. For instance, a modem will typically interface with the telephone subscriber line with a standard RJ-11 media jack and modular plug type of arrangement. Similarly, a network interface card may be connected to a communications network via a RJ-45 jack and plug.

Where such telecommunications devices are of a larger size, such as an external, desktop size modem for instance, the incorporation of such a media jack connector within the device itself is relatively straight forward. However, the incorporation of this type of connector is more difficult in miniature, or smaller sized communications devices, such as those that conform with the PCMCIA-specified architectures, or similar devices that are incorporated within handheld or notebook sized computer devices.

In these types of devices, the ability to provide a suitable connector arrangement is often limited by the spatial limitations of the device itself. Thus, there have been a variety of attempts to provide a suitable interface with standard modular connection schemes—such as the RJ-type arrangement—that can be implemented within a very limited physical space. Often, such approaches provide a media interface, or media jack, that can be retracted and stored within the physical confines of the device housing when not in use. When needed, the media jack can be extended out from the housing and provide a suitable interface for connecting to a corresponding modular plug. While these types of approaches are very satisfactory in terms of providing a media connection that can be implemented and used within smaller-sized environments, they do present a variety of additional problems. For instance, such connection devices often have a number of parts that can be difficult to assemble, manufacture and service. Moreover, the assemblies may be more prone to failure with prolonged use.

FIG. 1 illustrates one example of a communications card 10 of the prior art. Communications card 10 is of the sort that conforms with the size limitations specified by the PCMCIA architecture standard. It includes a printed circuit board 12, which contains corresponding circuitry for implementing a particular communications function, such as a modem. Also included is a suitable media jack 14 designed for receiving a corresponding modular plug, such as a standard RJ-type jack and plug arrangement.

The jack is electrically interconnected with the corresponding circuitry on the printed circuit board by way of a suitable internal connector, such as a flexible ribbon cable 16. In the example shown, the retractability of media jack 14 is provided, in part, by way of a media jack adaptor assembly 18, which essentially is comprised of a plastic U-shaped frame 20. Frame 20 includes a track 21, along which the media jack 14 can be extended and retracted.

Moreover, frame 20 may include a spring post 22. Corresponding spring 19 biases media jack 14 toward the extended position, and can be compressed when media jack 14 is in a retracted position. A suitable arrangement is also provided to retain the jack within the retracted position, and that allows a user to selectively extend the jack when needed. For instance, a cam follower 23 can be positioned between media jack 14 and a cam track 24 configured within frame 20. Cam follower 23 follows the path of cam track 24 as media jack 14 is extended and retracted.

FIG. 1*a* shows a cutaway view of a front comer portion of assembled card 10 in which spring 19 is mounted on spring post 22 and plates 25, 26 are mounted on frame 20. As shown in FIGS. 1 and 1*a*, as a hub 27 of media jack 14 slides along track 21 of frame 20, tabs 28, 29 on hub 27 slide within respective opposing slots 30, 31 of track 21 while opposing tabs 32, 33 slide along an outside surface of track 21. Stops 34, 35 in respective slots 30, 31 of track 21 limit the extension of media jack 14 out of track 21.

Also as shown, frame 20 is mounted between upper and lower thin metallic shells 25, 26. Shells 25, 26 are configured with surfaces that correspond in size and shape with the edges of frame 20. Lips 36, 37 on the sides of respective shells 25, 26 extend into respective grooves 38, 39 in upper and lower portions of frame 20. A thermally activated adhesive material 41 placed on shells 25, 26 joins shells 25, 26 permanently to opposing sides of frame 20.

Despite the many advantages of adaptor assembly 18, the sandwiching of frame 20 between shells 25, 26 is a cumbersome process. For instance, frame 20 is a flimsy molded component and is cumbersome to handle and mate with shells 25, 26. Furthermore, the bond accomplished through the use of adhesive material 41 between frame 20 and shells 25, 26 is subject to failure over time.

FIGS. 2 and 2*a* illustrate yet another example of a communications card 40 assembled in accordance with the teachings of the prior art. Card 40 is shown in a partially assembled, exploded view. Communications card 40 features upper and lower shells 42, 44, which substantially surround printed circuit board 45. A media jack 46 is also shown along with an adapter 48 for slidably receiving jack 46. A cam follower 50 and leaf spring 52 for biasing cam follower 50 into cam track 53 as jack 46 moves along adaptor 48 are also shown. Spring 54 is provided and mounted on spring post 55 for biasing against jack 46.

Media jack 46, circuit board 45, springs 52 and 54, cam follower 50 and adaptor 48 are mounted between shells 42, 44. Shells 42, 44 include respective outer plastic rails 56, 57 mounted on metallic plates 58, 59 respectively. Plastic rails 56 of shell 42 have a groove 60 therein for receiving a ridge 61 on rails 57 of shell 44, such that rails 56, 57 can be coupled in a mating relationship. Rails 56, 57 are typically permanently joined through ultrasonic bonding.

Tabs 62, 64 extend from a rail 56 of shell 42. A phantom view of adaptor 48 is shown adjacent the tabs 62, 64 in FIG. 2. Grooves 66, 68 of adaptor 48 are secured to the tabs 62, 64. Tabs 62, 64 extend from the rail 56 over the metallic plate 58.

Since cam track 53 is configured within jack 46, transversely oriented leaf spring 52 is required for biasing cam follower 50 into track 53. Leaf spring 52 can become bent, causing it to press at the wrong angle against cam follower 50. Also, leaf spring 52 adds additional complexity to the assembly and the manufacture thereof.

The assembly can present additional problems as well. For instance, cam follower 50 can be difficult to properly mount within adaptor 48, and can become disconnected during assembly. In addition, the dovetail coupling of adaptor 48 to tabs 62, 64 results in the adaptor 48 being coupled only to a single shell 42. Furthermore, a stop 70 is required to be placed on jack 46 to prevent media jack 46 from exiting the assembled communications card housing. In addition, cam track 53 is exposed outside of the assembled card when media jack 46 exits the housing, and can thus be subject to damage.

There is therefore a need in the art for an improved media jack adaptor assembly and associated adapter housing. More specifically, there is a need in the art for a media jack adaptor which can be more conveniently and efficiently mounted within the housing of a communications card.

SUMMARY AND OBJECTS OF THE INVENTION

It is therefore an object of the invention to provide an improved media jack adaptor for movably receiving a media jack.

It is another object of the invention to provide an improved housing for mounting a media jack adaptor thereon.

It is another object of the invention to provide an improved system and method for housing a media jack and for movably adapting the media jack to the housing.

It is another object of the invention to provide a system having a pair of shells and a media jack adaptor mounted therebetween for movably receiving a media jack.

It is another object of the invention to develop a system and method which enables improved automated assembly of a communications card.

One presently preferred embodiment of the present invention comprises an adaptor and a housing that are particularly useful in connection with a PCMCIA-architecture communications card. In general, the adaptor is configured so as to be implemented within the housing defined by the communications card. Moreover, the adapter permits a media jack, such as a standard RJ-type modular connector, to be selectively and slidably received within the communications card housing.

An example of an adaptor constructed in accordance with the teachings of the present invention features an adaptor body having (i) a track for movably receiving the media jack; and (ii) a cam track or other means for arresting the movement of the media jack along the track. In addition, in a preferred embodiment the adaptor includes a wing portion that is adapted and configured to couple the adaptor to the desired object, such as the housing of the communications card. For instance, the wing preferably has a plurality of apertures and posts that are arranged and oriented so as to provide suitable means for aligning and coupling the adapter to the interior of the card housing, which is formed with corresponding and complimentary shaped structures.

In one embodiment, apertures are formed within the wing portion of the adapter and are positioned and configured so as to receive correspondingly sized and shaped posts that extend from a first shell portion of the housing. Also, a second shell portion of the housing has receiving sockets that are also positioned and configured so as to receive the same posts. In an assembled state, the wing of the media jack adaptor is mounted onto the posts of the first shell. The second shell is then mounted onto the posts, which extend through the apertures formed within the wing portion. The media jack adaptor is thus conveniently sandwiched and aligned between the upper and lower shells, and is secured by way of the wing apertures, and the corresponding shell posts and sockets.

In a further preferred embodiment, the shells that form the communications card housing include bonding sites formed around the edges thereof, where rails are mounted on the plates of the shells. Mating bonding sites are formed in opposing rails. The mating bonding sites are formed through the use of mating posts and sockets in opposing rails. Mating rails on one side of the shells each have a platform configured to receive the wing of the adaptor therein. Posts extend from the platform of one rail for mating within the apertures of the wing.

The adaptor and housing system have a variety of advantages. The adaptor may receive a variety of different cam followers and a variety of different media jacks thereon. The adaptor may be mounted on to a variety of different objects, including the housing shells and other equipment or devices. The wing of the adaptor has substantially the same length as the body of the media jack, and thereby conserves space. The configuration also conserves materials and provides for convenient and efficient mounting of the adaptor between the shells. The posts and sockets ensure that the housing assembly and the adapter are attached in an aligned relationship, and thereafter maintain the adaptor in a fixed, tight relationship.

The adaptor may be held mechanically between the shells or may be mounted therebetween through ultrasonic bonding. The posts which couple the shells to each other are parallel to the posts which couple to the adaptor. Thus, it is possible during the compression and ultrasonic bonding of the shells to simultaneously compress and ultrasonically bond the wing to the posts configured to extend through the wing.

In addition to ultrasonic bonding, the adaptor of the present invention may be coupled together to the housing shells through variety of different means, including mechanical means such as screws and the like, adhesives and various chemical bonding techniques, heat bonding, compression fit, or a variety of other means known in the art. Similarly, the shells may be coupled through a variety of different means.

These and other objects, features and advantages of the present invention will become more fully apparent from the following description and appended claims, or may be learned by the practice of the invention as set forth hereinafter.

DETAILED DESCRIPTION OF THE PREFERRED EMBODIMENTS

Figure 3:
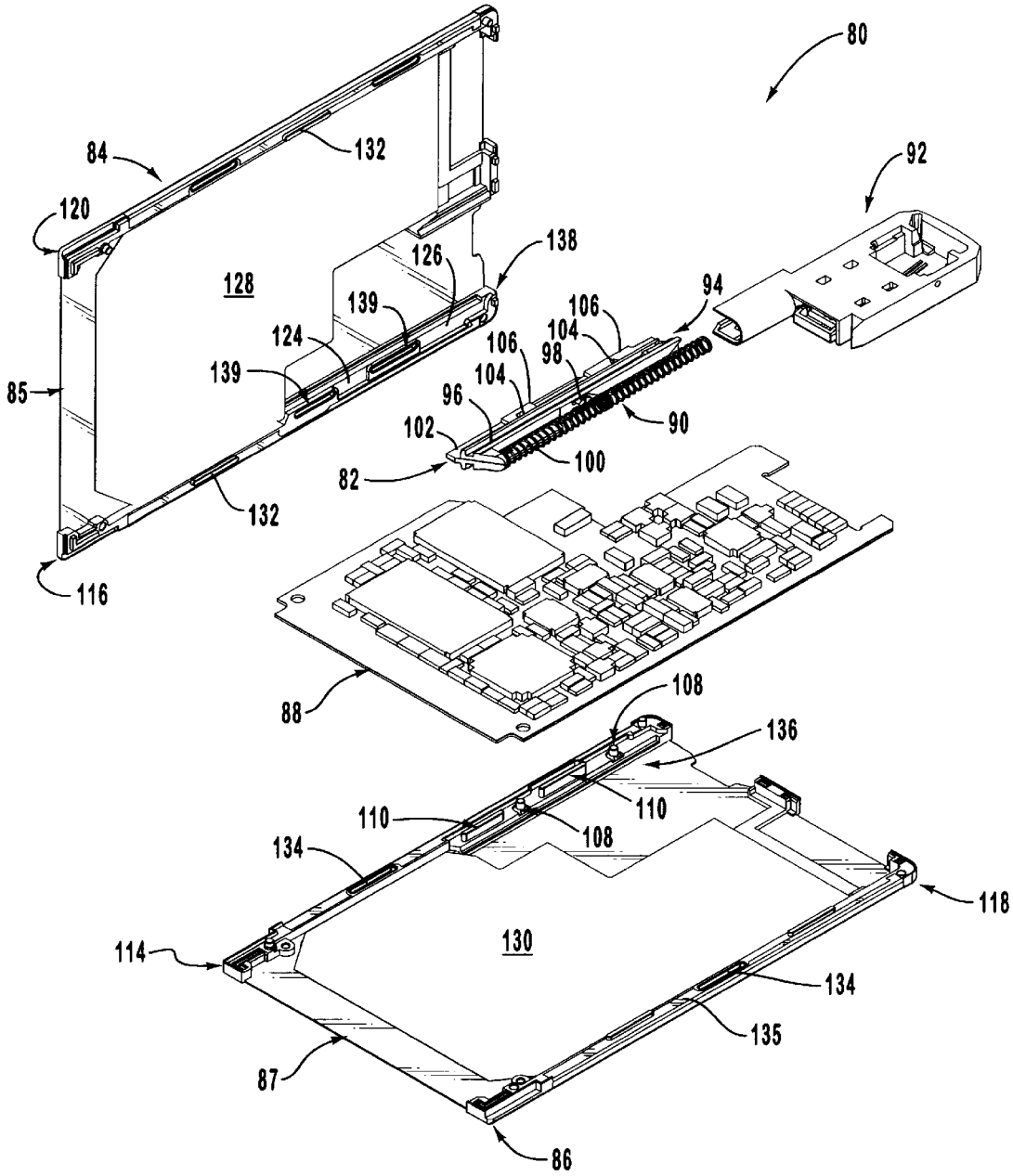
FIG. 3 is an exploded view of a communications card of the present invention having a media jack adaptor of the present invention shown separate from a media jack.

With reference now to FIG. 3, an exploded view of a communications card 80 of the present invention is shown. Communications card 80 features an adaptor 82 and housing shells 84, 86 of the present invention. Communications card 80 also includes a printed circuit board 88, a biasing spring 90 and a media jack 92.

Circuit board 88 contains circuitry for implementing a particular communications function, such as a modem. Media jack 92 is preferably designed for receiving a corresponding modular plug, such as a standard RJ-type jack and plug arrangement, thereby electrically coupling the plug to circuit board 88.

Adaptor 82 is configured for movably receiving media jack 92 and is configured to be coupled to a desired object, e.g., shell 84 or shell 86 and preferably both shells 84, 86. Adaptor 82 comprises an elongate body 94 having (i) a track 96 for movably receiving media jack 92; and (ii) means for arresting the movement of media jack 92 along track 96, such as cam track 98 which receives a cam follower coupled to jack 92. In addition, adaptor 82 further comprises a spring post 100 coupled to adaptor body 94 for mounting spring 90 thereon. Spring post 100 and spring 90 mounted thereon serve collectively as an example of means for biasing media jack 92 in a desired direction.

Adaptor 82 further comprises (i) a wing 102 extending from one side of adaptor body 94; and (ii) means for coupling wing 102 to an object, e.g., shells 84, 86. Wing 102 (also shown in FIGS. 6*a*–6*c*) defines a plane, and the means for coupling wing 102 to shells 84, 86 extends transversely to the plane of wing 102.

Examples of the transversely extending coupling means include (i) apertures 104, 105 (apertures 105 shown in FIGS. 6*b*–6*c*) which extend through the plane of wing 102, (ii) posts 106 on wing 102 which mate within a portion of shell 84, (iii) posts 108, 110 of shell 86 which extend into apertures of wing 102, and a variety of other transversely extending members or devices. Posts 106 of wing 102 have apertures 104 extending therethrough, but other posts may extend from wing 102 for mating with shell 84 which do not feature apertures therethrough.

By extending transversely to the plane of wing 102, apertures 104, 105, and posts 106, 108, and 110 enable wing 102 to be conveniently mounted above and/or below a given shell. Thus, wing 102 can be sandwiched between the shells 84, 86. The ability of wing 102 to be mounted above or below an object, and preferably between first and second shells 84, 86 provides a variety of different advantages. First, gravity assists in bonding adaptor 82 and the object together during manufacturing and in use. Second, adaptor 82 may be retained between shells 84, 86 while shells 84, 86 are coupled together. Thus, adaptor 82 may be either bonded ultrasonically or otherwise to one or more shells 84, 86, or may be held mechanically between shells 84, 86. Adaptor 82 is preferably made from a plastic material, such as a nylon, reinforced nylon or other plastic material.

With continued reference to FIG. 3, housing shells 84, 86 each comprise base plates 85, 87, respectively and a plurality of rails 114, 116, 118, 120 extending along the edges of respective base plates 85, 87. Base plates 85, 87 preferably each comprise a substantially planar, metal material, while rails 114, 116, 118, 120 preferably each comprise a plastic material, such as nylon, reinforced nylon or another plastic material. A protective layer 128, 130 of an insulating material is disposed on respective plates 85, 87 to thereby protect the electrical components of printed circuit board 88 which is sandwiched between shells 84, 86.

Mating posts and sockets extend from and are formed within respective mating rails 114, 116 and mating rails 118, 120 for coupling shells 84, 86 to each other. For example, posts 132 mate with sockets 134 when shells 84, 86 are coupled. Preferably, shells 84, 86 are ultrasonically bonded by ultrasonically bonding mating rails.

Rails 114, 116, 118, 120 may be mounted on respective plates 85, 87 through a variety of different processes, including mechanically mating the rails and the plates, molding of the plastic rails to the metal plates 85, 87, bending metallic outer flanges 135 partially around the rails, molding portions of rails over tabs (not shown) extending from the plates 85, 87 such that the tabs retain the rails on the plates, molding portions of the rails around the comers of the plates (see FIG. 5), or combinations thereof.

Rail 114 in lower shell 86 includes a lower platform 136 while from rail 116 in upper shell 84 includes an upper platform 138. Platforms 136, 138 preferably comprise a plastic material and receive wing 102 of adaptor 82 therebetween in mating relationship. Apertures 105 (FIGS. 6*b*–6*c*) of wing 102 can be placed on posts 110 extending from platform 136, after which the sockets 139 of platform 138 are placed on posts 110, thereby coupling wing 102 securely between rails 114, 116. Posts 106 of wing 102 extend into the recesses 124, 126 in platform 138. As shown, adaptor posts 108, 110 may be cylindrical, oblong or rectangular posts, as shown, or a variety of other configurations, including square shapes or other designs.

Ultrasonic bonding of adaptor 82 to shells 84, 86 may occur during the ultrasonic bonding of shells 84, 86 to each other because compression is applied in the same direction during ultrasonic bonding. The posts, e.g., 132 which couple shells 84, 86 to each other are parallel to the posts 108 which couple to adaptor 82. Furthermore, posts 110 couple shells 84, 86 together and couple shells 84, 86 to adaptor 82. Thus as shells 84, 86 are being compressed during the ultrasonic bonding thereof, adaptor 82 can be simultaneously compressed between shells 84, 86. Nevertheless, the rails and adaptor may be coupled together through a variety of different means, such as trough the use of a mechanical fit, an adhesive, heat, chemicals, compression fit, screws, or a variety of other means known in the art.

In light of the configuration of shells 84, 86 and adaptor 82 it is possible to assemble card 80 using an efficient process. In one embodiment, following assembly of media jack 92 such that the cam follower is mounted therein, spring 90 is mounted on spring post 100 through an automated process, after which media jack 92 is mounted onto adaptor 82 through an automated process.

Figure 4:
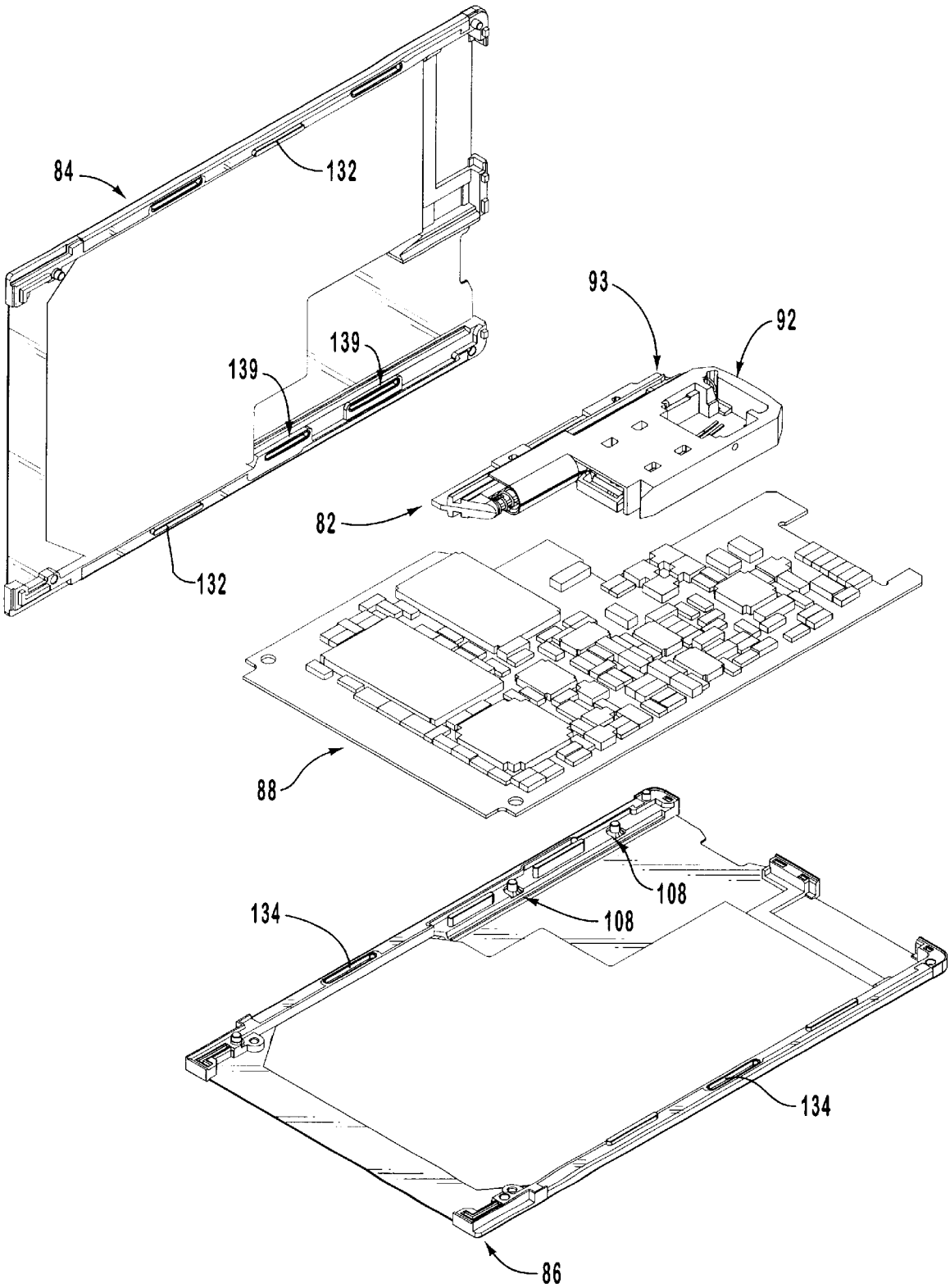
FIG. 4 features the communications card of FIG. 3 with the media jack of FIG. 3 slidably mounted onto the media jack adaptor of FIG. 3.

FIG. 4 demonstrates that, in one embodiment, the media jack/adaptor component is formed after which the component is placed into shell 86, followed by circuit board 88, which is placed in shell 86, after which shell 84 is placed on top of shell 86, sandwiching the jack/adaptor combination and circuit board 88 therebetween. In another embodiment, circuit board 88 is placed into shell 86 before the jack adaptor combination is placed in shell 86. Once the package is assembled, it is possible to ultrasonically bond shells 84 and 86. In one embodiment, only the rails are ultrasonically bonded and the wing 102 of the adaptor 82 is merely held in place through a mechanical coupling.

The combined media jack/adaptor component can be mounted on lower shell 86 through an automated process after which upper shell 84 is mated therewith, also through an automated process. It can be seen from a view of FIG. 4 that the adaptor/media jack combination can be readily mounted onto plates 84, 86, which is a convenient manufacturing option.

Thus, in one embodiment, media jack 92 is mounted onto adaptor 82, which is then sandwiched between shells 84, 86. In another embodiment, however, adaptor 82 is sandwiched between shells 84, 86, after which media jack 92 is pressed through the cavity between shells 84, 86 and onto adaptor 82.

Figure 5:
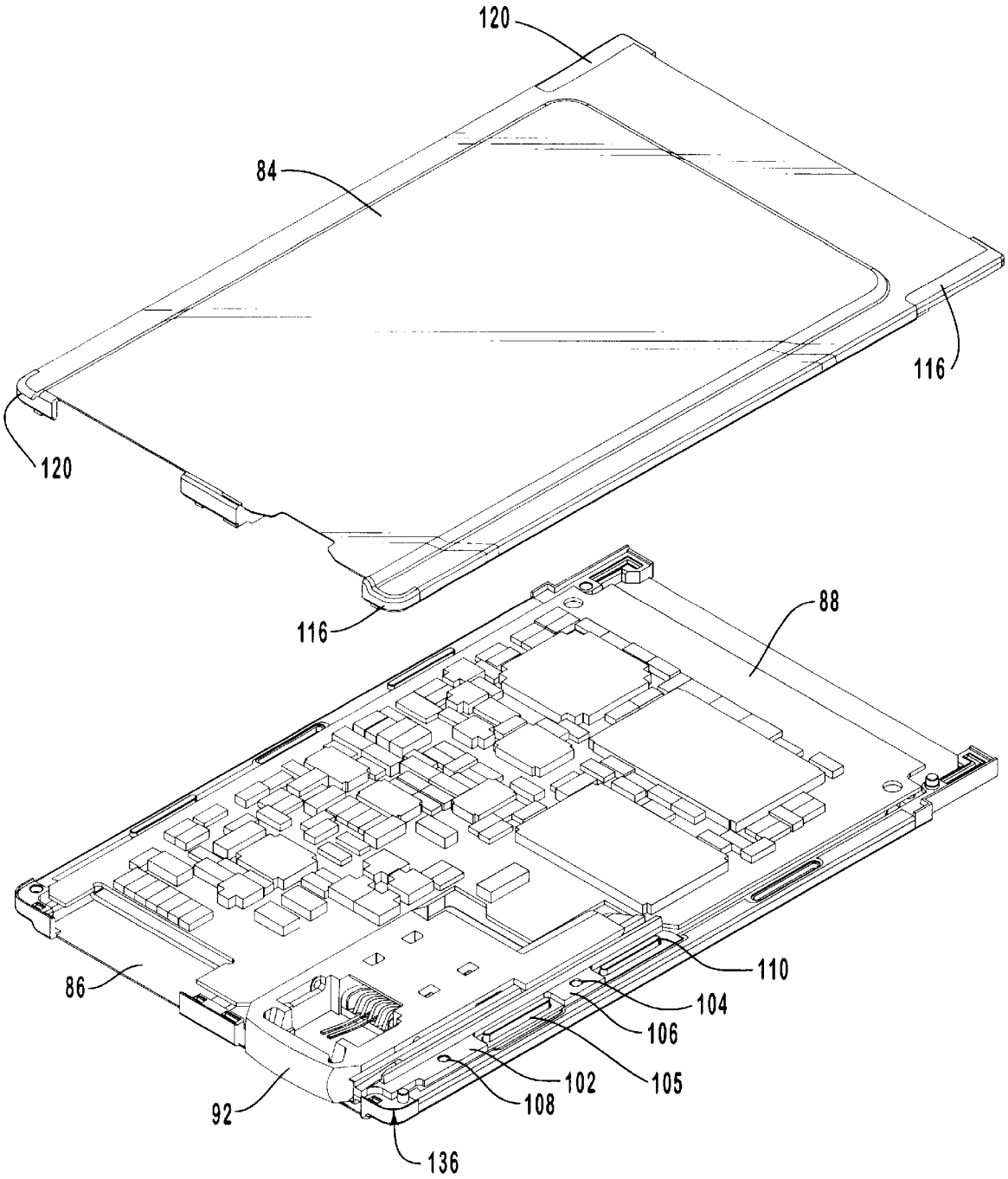
FIG. 5 is a view of the communications card of FIG. 4 with the combined media jack adaptor and media jack shown as being mounted onto the lower shell of the communications card.

With reference now to FIG. 5, circuit board 88, adaptor 82 and media jack 92 are shown as being disposed within lower shell 86 before shell 84 is placed thereon. Wing 102 of adaptor 82 is coupled to the posts 108, 110, which are disposed through respective apertures. It will be appreciated that in one embodiment posts 108, 110 extend integrally from platform 136. In light of the vertical relationship of posts 108, 110 through apertures 104, 105, adaptor 82 is held between shells 84, 86.

Figure 1:
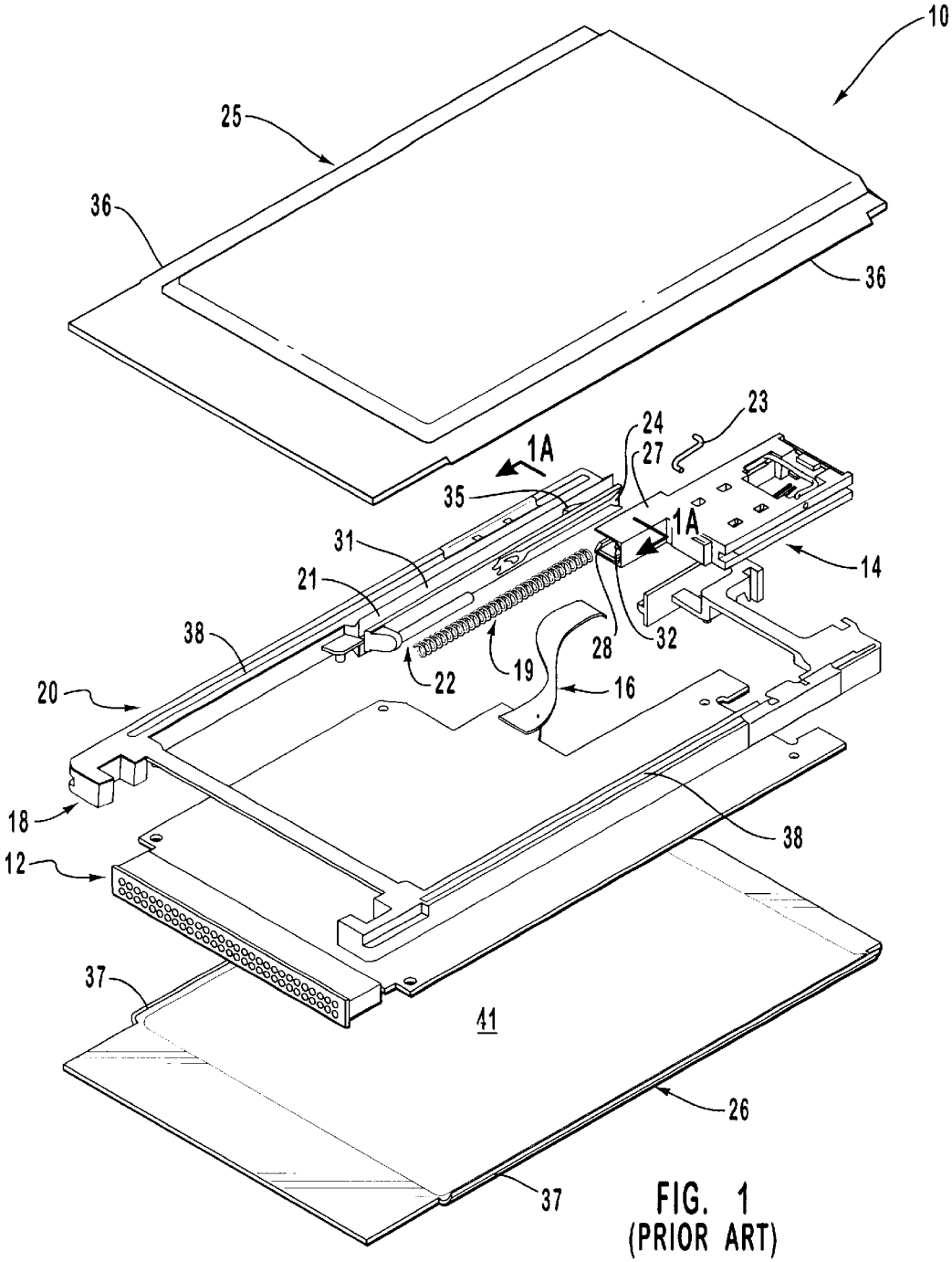
FIG. 1 (PRIOR ART)
FIG. 1 is an exploded view of a communications card of the prior art.

A variety of different means for providing communication between media jack 92 and circuit board 88 may be used in the present invention, such as flexible ribbon cable 16 of FIG. 1 or an electric or infrared sensor positioned between media jack 92 and circuit board 88.

Figure 1A:
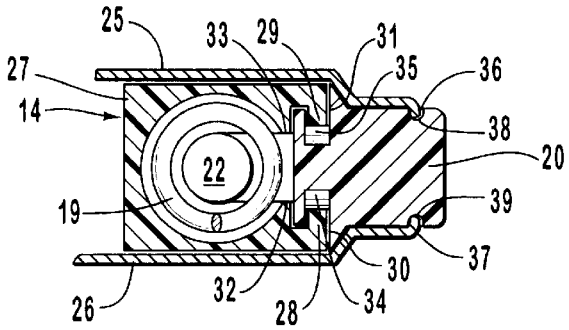
FIG. 1A (PRIOR ART)
FIG. 1*a* is a cross sectional, cut away view of a front corner of the assembled communications card of FIG. 1.
Figure 2:
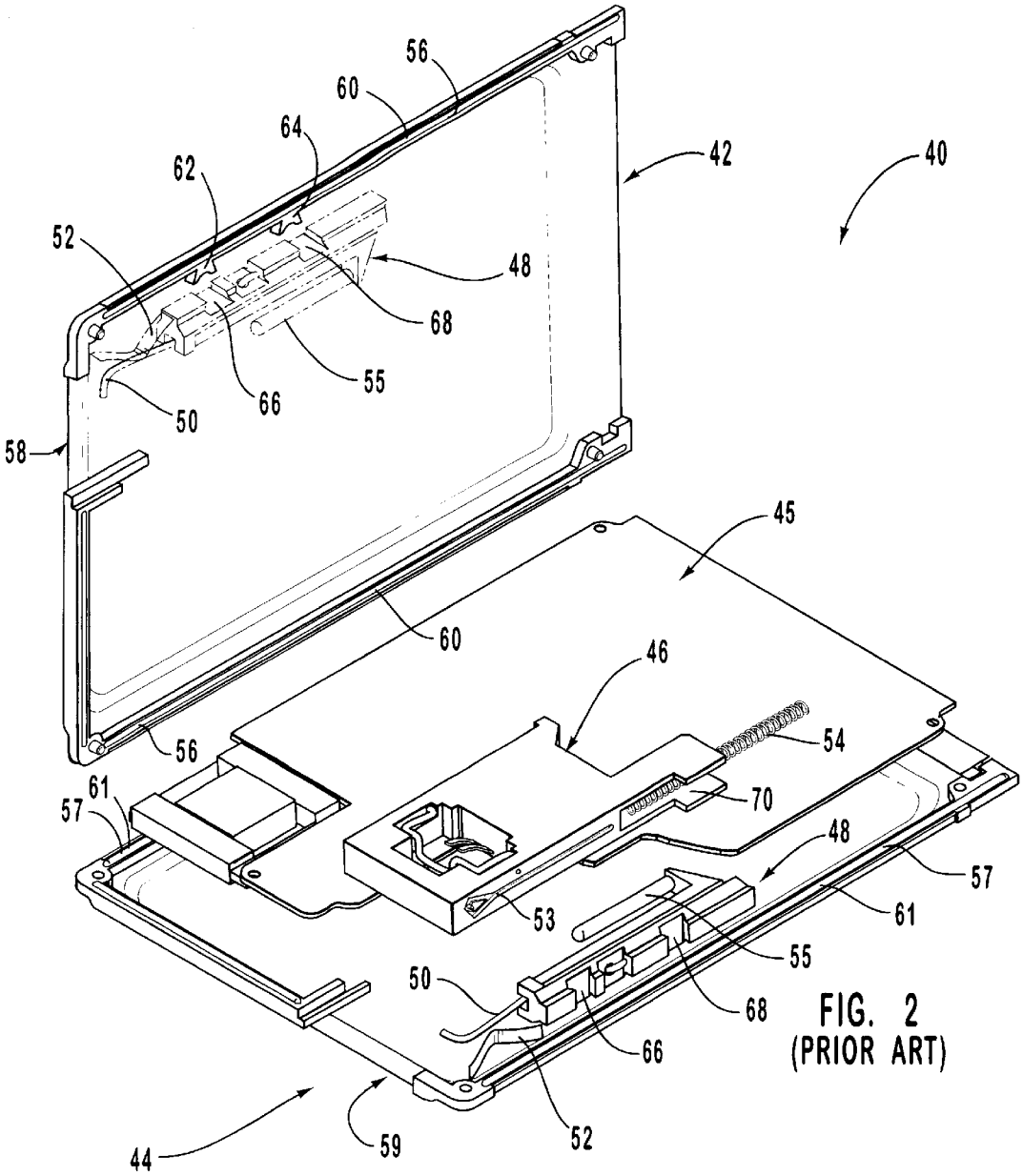
FIG. 2 (PRIOR ART)
FIG. 2 is a partially assembled, exploded view of another communications card of the prior art.
Figure 2A:
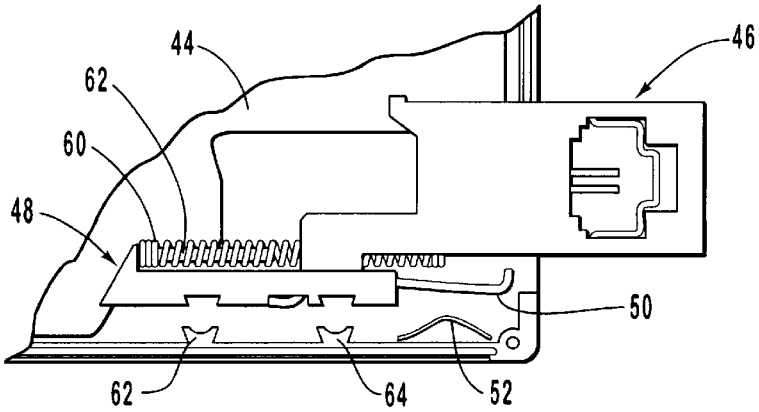
FIG. 2A (PRIOR ART)
FIG. 2*a* is a partially assembled cut-away view of the communications card of FIG. 2.
Figure 6A:
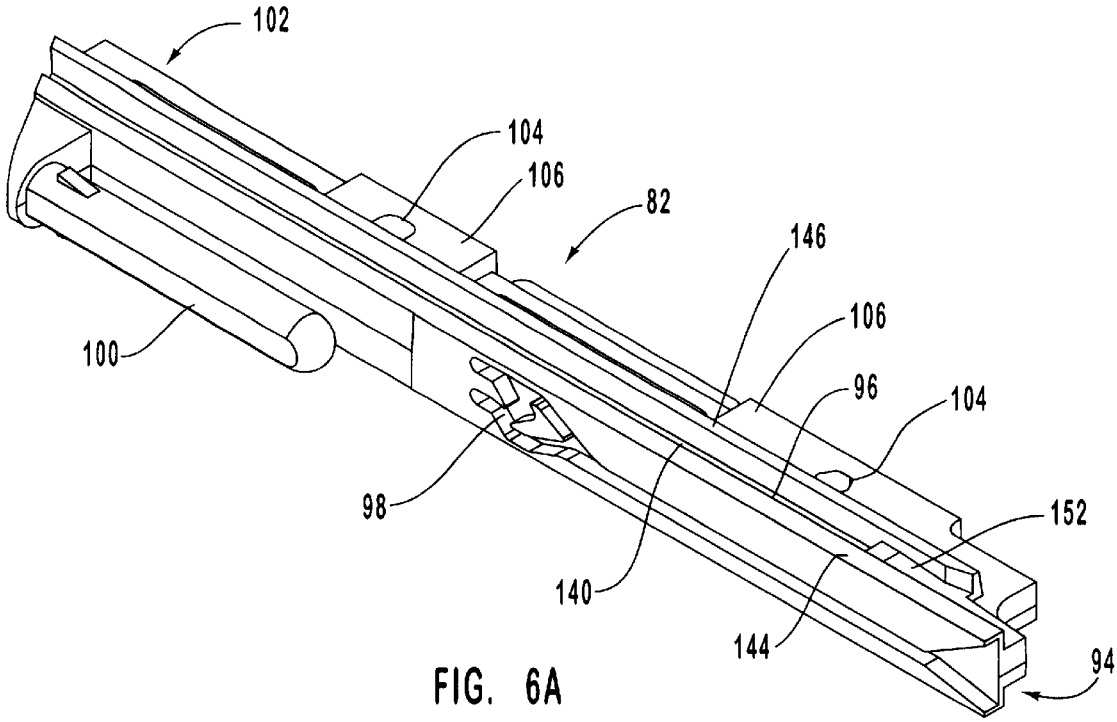
FIG. 6*a* is a perspective view of the inner surface of the media jack adaptor of FIG. 3, featuring the spring post and the cam track on opposing ends of the media jack adaptor.
Figure 6B:
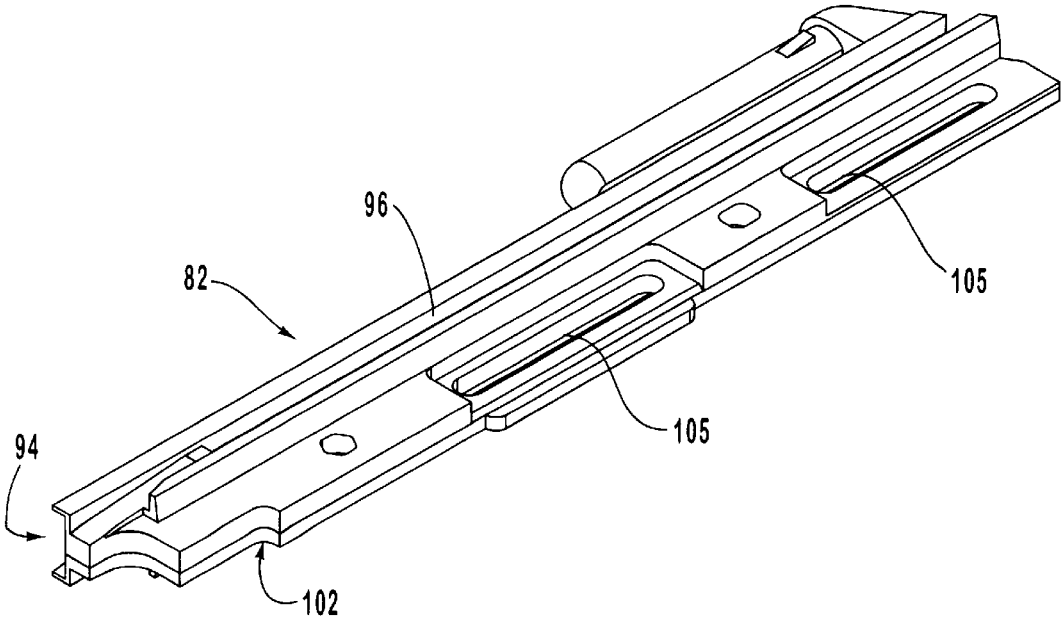
FIG. 6*b* is a perspective view of the outer surface of the media jack adaptor of FIG. 3.
Figure 6C:
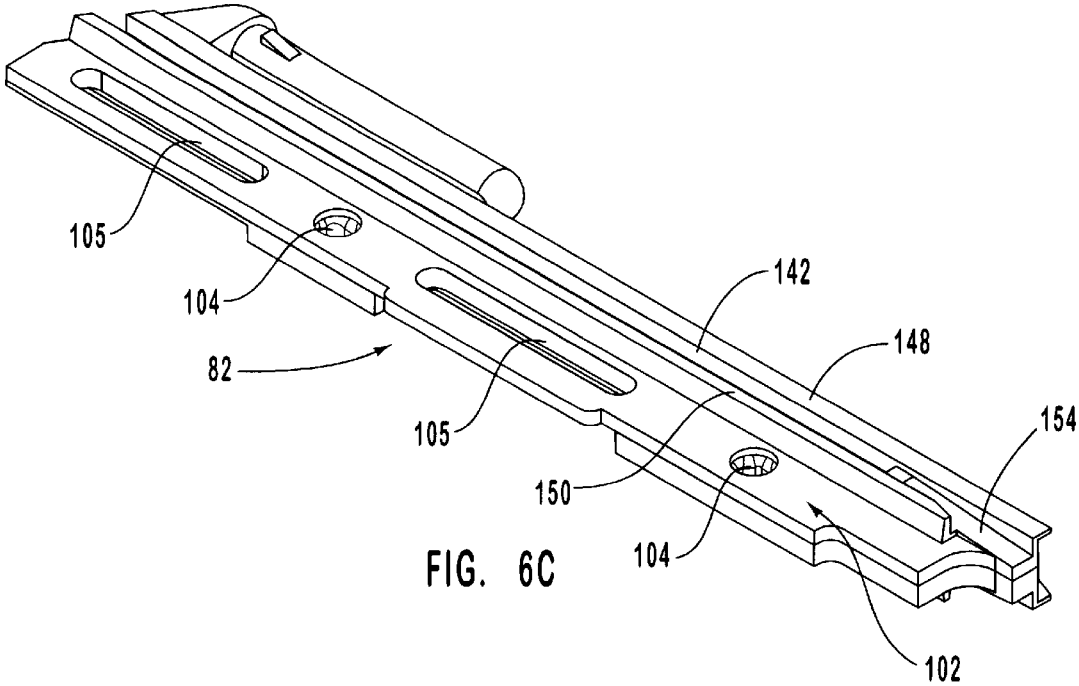
FIG. 6*c* is a bottom view of the media jack adaptor of FIG. 6*a* and 6*b*.

With reference now to FIGS. 6*a* through 6*c*, adaptor 82 is shown. As mentioned above, adaptor 82 comprises an adaptor body 94 having a track 96 for slidably receiving a media jack 92. Track 96 has first and second opposing slots 140, 142 in which tabs of media jack 92 slide. Slot 140 is defined in part by ridges 144, 146 of body 94. Slot 142 is defined in part by similar ridges 148, 150 on an opposing side of body 94. Tabs of media jack 92 may also be positioned outside of slots 140, 142 such that media jack 92 is movably mounted on track 96 and held in place by the tabs inside and outside of slots 140, 142. The tabs of jack 92 may be similar or identical to tabs 28, 29, 32 and 31 discussed above with regard to FIG. 1*a*, for example.

Cam track 98 is configured within the body 94 of adaptor 82. The advantage of configuring the cam track 98 within body 94 is that a variety of different cam followers may be employed when coupled to media jack 92 or another media jack.

Cam track 98 and an associated cam follower are collectively an example of means for arresting the movement of media jack 92 along track 96. Cam track 98 movably receives a cam follower such as cam follower 23 shown in FIG. 1 or a variety of different cam followers known in the art or yet to be produced.

For example, in one embodiment, the cam follower comprises a cam follower described in United States patent application to Madsen, et al., entitled "System and Apparatus for Retaining Position of Cam Follower," filed on Nov. 30, 1998, Ser. No. 09/201,682 with the United States Patent Office, which is incorporated herein by reference.

In addition, a variety of different media jacks may be employed in the present invention such as the media jacks disclosed in the above referenced patent application to Madsen, et al entitled "System and Apparatus for Retaining Position of Cam Follower." A hole in media jack 92 restrains one end of the cam follower while track 98 allows the opposing end of the cam follower to slide thereon. A cable is another example of a media jack which could be pushed onto an adaptor such as adaptor 82 and lock in a selectively moving or a static position.

Track 96 further has stops 152, 154 in respective opposing slots 140, 142 thereof for arresting the movement of media jack 92 past the end of track 96. Preferably, each stop 152, 154 is angled so as to serve initially as a ramp as the media jack 92 is initially placed onto the track 92. Each stop 152, 154 serves as another example of means for arresting the movement of the media jack along track 96.

There are a variety of other examples of means for arresting the movement of the media jack along track 96. Cam track 98 is an example of a groove for selectively arresting the movement of jack 92 when it is desired to orient jack in a retracted position. Another example of a means for arresting the movement of jack 92 is a groove formed within body 98 which selectively receives a spring-loaded latch. An example of such a latching mechanism is a one-sided barb which slides or otherwise moves into the groove and then can be removed through the use of a button which is pushed in order to unlatch the latch from the groove. Examples of other arresting means are disclosed in a U.S. patent application entitled "Multiple Use Port and Devices Interfacable Therewith," filed on Nov. 30, 1998, Ser. No. 09/201,647, which is incorporated herein by reference.

Another example of the means for arresting movement of a media jack is the use of tabs oriented on the media jack which prevent the media jack from moving once all of the tabs on the jack are initially moved over stops 150, 152. In this embodiment, the means for arresting the movement of the media jack allows a single one-way sliding movement onto the adaptor. As an example of this embodiment, a front and back set of tabs are disposed on the media jack and the media jack is locked in place after both sets of tabs are pushed over the stops 152, 154. Another example of a means for arresting the movement of a media jack is a protuberance extending from the body of the adaptor.

Figure 7:
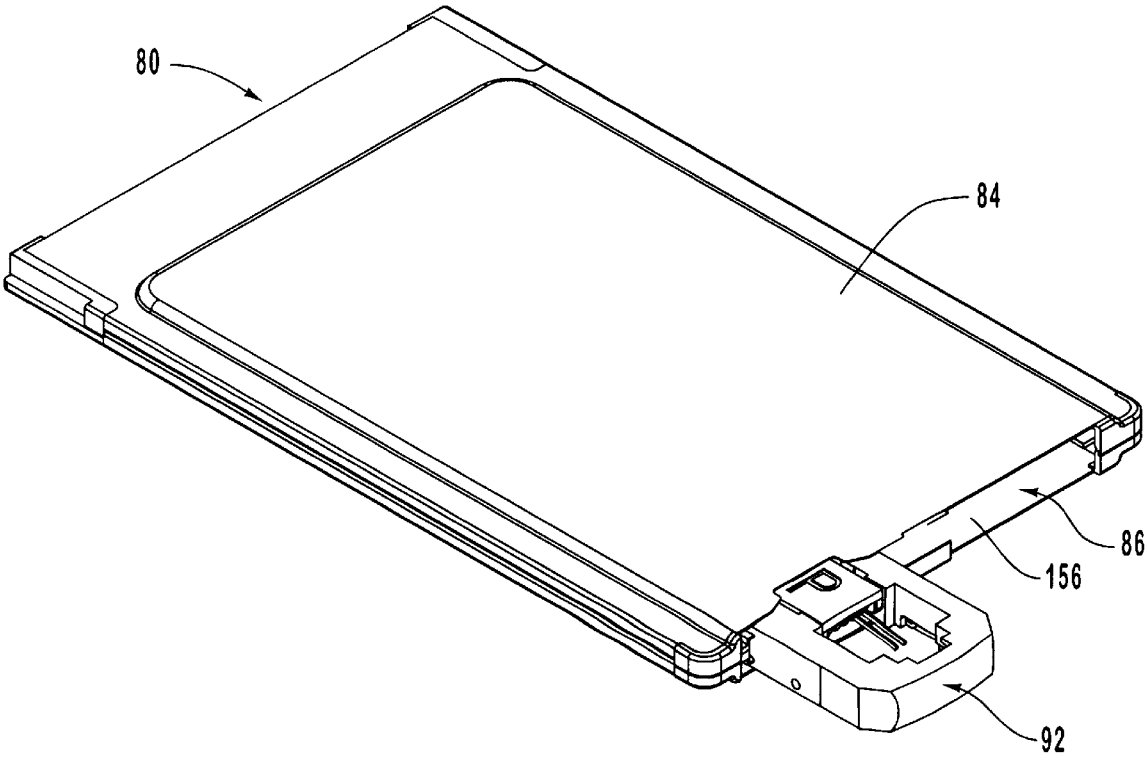
FIG. 7 is a perspective view of the assembled communications card of FIG. 3, having the media jack thereof shown in an extended position.

FIG. 7 shows an extended view of a retractable media jack 92 extending from plates 84, 86 of communications card 80. In the embodiment shown, an aperture 156 exists between shells for the placement of a coupler coupled to the circuit board, for example. Also as shown in FIG. 7, shells 84, 86 define a plane. The means for coupling wing 102 to at least one of the shells 84, 86, (e.g., apertures 104, 105 and posts 108, 110) and preferably both shells, extends transversely to the plane of the shells 84, 86.

A communications card incorporating the adaptor 82 and shells 84, 86 of the present invention is easily automatible and can be fitted to multiple devices or applications. The adaptor 82 can fit in or on a variety of different objects. It can be attached to a communications card, internally within a laptop or other computer or any other number of electronic devices. In addition, adaptor 82 can fit into a cellular phone, on a table, or on a variety of areas, as opposed to being dependent upon a certain kind of frame. With the newly invented adaptor and shell system, the number of required parts is fewer, product cost is less and manufacturing is substantially less complicated than in previous systems.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An adaptor for receiving a media jack, the adaptor configured to be coupled to a desired object, the adaptor comprising:

an elongated adaptor body including a first end and a second end;

a track for slidably receiving the media jack, the track extending from the first end of the elongated adaptor body towards the second end of the elongated adaptor body;

means for arresting movement of the media jack along the track of the adaptor body;

a wing extending from one side of the adaptor body, the wing including an upper surface and a lower surface, the wing extending substantially the entire length of the elongated adaptor body;

two or more apertures extending through the upper surface and the lower surface of the wing, the apertures being sized and configured to couple the wing to the object; and at least one slot located between two of the apertures, the slot for aligning the wing relative to the object.

2. An adaptor as recited in claim 1, further comprising one or more mating surfaces located on an outer surface of the wing, the mating surfaces being sized and configured to be attached to first and second shells of a communication card.

3. An adaptor as recited in claim 1, further comprising a post extending from the wing that is configured to be attached to a shell of a communication card.

4. An adaptor as recited in claim 1, wherein the wing has substantially the same length as the track for slidably receiving the media jack.

5. An adaptor as recited in claim 1, further comprising means for biasing the media jack in a desired direction along the elongated track, the means for biasing the media jack in a desired direction along the track positioned on an opposing side of the adapter body from the wing.

6. An adaptor as recited in claim 5, wherein the means for biasing the media jack in a desired direction includes a spring post attached to the adaptor body and a spring at least partially disposed on the spring post.

7. An adaptor as recited in claim 1, wherein the means for arresting the movement of the media jack along the track of the adaptor body comprises a cam track.

8. An adaptor for receiving a media jack, the adaptor configured to be coupled to a desired object, the adaptor comprising:

an adaptor body including an elongated track for slidably receiving a media jack, the elongated track including a length and extending from one end of the body towards another end of the body;

a wing extending from one side of the adaptor body, the wing being located in a plane generally orthogonal to a plane including the elongated track;

two or more apertures extending through the wing, the apertures being sized and configured to couple the adaptor body to the object;

one or more posts extending transversely from the plane containing the wing, the posts being sized and configured to couple the adaptor body to the object; and one or more slots located between the apertures or posts, the slots being sized and configured to align the adapter body relative to the object.

9. An adaptor as recited in claim 8, further comprising means for arresting movement of the media jack along the track of the adaptor body.

10. An adaptor for movably receiving a media jack within a PCMCIA-architecture communications card, the communications card including a housing with a first shell and a second shell, the first shell including one or more posts and the second shell including one or more recesses, the adaptor comprising:

an adaptor body including a track for movably receiving the media jack;

means for arresting the movement of the media jack along the track of the adaptor body;

a wing extending from one side of the adaptor body;

one or more apertures located in said wing, the apertures being sized and configured to receive the one or more posts of the first shell to connect the wing to the first shell of the PCMCIA-architecture communications card; and one or more posts attached to the wing, the posts being sized and configured to be inserted into the one or more recesses in the second shell to connect the wing to the second shell of the PCMCIA-architecture communications card.

11. An adaptor for movably receiving a media jack within a PCMCIA-architecture communications card, the adaptor comprising:

an adaptor body including an elongated track for movably receiving the media jack, the adaptor body having a length and a thickness;

means for arresting the movement of the media jack along the track of the adaptor body; and a wing extending from one side of the adaptor body, the wing having generally the same length as the adaptor body, the wing having a thickness less than the thickness of the adaptor body, the wing including an upper surface and a lower surface;

one or more posts attached to the upper surface of the wing, the posts being sized and configured to attach the wing to a shell of the PCMCIA-architecture communications card; and one or more apertures located in the one or more posts, the apertures being sized and configured to attach the wing to another shell of the PCMCIA-architecture communications card.

12. An adaptor as recited in claim 11, wherein the wing defines a plane, and wherein the one or more posts extend transversely to the plane of the wing.

13. An adaptor as recited in claim 11, wherein the means for arresting the movement of the media jack along the track of the adaptor body comprises a cam track.

14. A system for housing and receiving a media jack, comprising:

an adaptor comprising:

an elongated adaptor body including an elongated track for slidably receiving the media jack, the elongated track including a first end and a second end, the elongated track and the adaptor body having generally the same length;

a wing extending from one side of the adaptor body, the wing having generally the same length as the adaptor body, the wing including an upper surface and a lower surface;

one or more posts attached to the upper surface of the wing;

one or more apertures located in the one or more posts;

one or more slots positioned between the posts or the apertures, the slots for aligning the adaptor body; and a PCMCIA-architecture communications card including a first shell and a second shell, each shell including a plate and a rail, the rail of the first shell including one or more posts that are sized and configured to be inserted into the one or more apertures in the wing, the rail of the second shell including one or more recesses that are sized and configured to receive the one or more posts attached to the upper surface of the wing wherein the wing is configured to be coupled to both the first and second shells of the PCMCIA-architecture communications card.

15. A system as recited in claim 14, wherein the rail of each shell comprises a platform, the platforms of the first and second shells configured to receive the wing of the adaptor therebetween.

16. A system for housing a media jack of a PCMCIA card, the system comprising:

a communications card including a first shell and a second shell, the shells being configured to substantially enclose a circuit board of the PCMCIA card, the shells defining a plane, the first shell including one or more upwardly extending posts and the second shell including one or more recesses; and an adaptor comprising:

an adaptor body including a track for movably receiving the media jack;

means for arresting the movement of the media jack along the track of the adaptor body;

a wing extending from one side of the adaptor body;

one or more posts in the wing that are sized and configured to be received within the one or more recesses in the second shell; and one or more apertures in the wing that are sized and configured to receive the one or more upwardly extending posts of the first shell.

* * * * *